US005552664A

United States Patent [19]

Csoknyai et al.

[11] Patent Number: 5,552,664

[45] Date of Patent: Sep. 3, 1996

[54] FLUORESCENT LAMPS WITH IMPRINTED COLOR LOGOS AND METHOD OF MAKING SAME

[75] Inventors: George Csoknyai, Orange, Conn.; Arpad L. Pirovic, Montvale, N.J.

[73] Assignee: Light Sources, Inc., Milford, Conn.

[21] Appl. No.: 268,205

[22] Filed: Jun. 29, 1994

[51] Int. Cl.[6] ..... H01J 1/62

[52] U.S. Cl. ..... 313/488; 313/514

[58] Field of Search ..... 313/488, 484, 313/485, 443, 635, 514; 362/255; 40/545, 553

[56] References Cited

U.S. PATENT DOCUMENTS

| | | | |
|---|---|---|---|
| 1,963,964 | 6/1934 | Barclay | 313/514 |
| 2,129,780 | 9/1938 | Nickel | 313/514 |
| 2,854,600 | 9/1958 | Weijer et al. | 313/488 |
| 3,225,241 | 12/1965 | Spencer et al. | 313/488 |
| 3,717,781 | 2/1973 | Sadoski et al. | 313/488 |
| 3,886,396 | 5/1975 | Hammer et al. | 313/488 |
| 3,912,828 | 10/1975 | Olwert | 313/488 |
| 4,061,946 | 12/1977 | Schreurs | 313/488 |

*Primary Examiner*—Sandra L. O'Shea
*Assistant Examiner*—Vip Patel
*Attorney, Agent, or Firm*—Fattibene and Fattibene; Arthur T. Fattibene; Paul A. Fattibene

[57] ABSTRACT

A fluorescent lamp having a logo, design or graphic information formed thereon. The glass envelope of the lamp is provided internally thereof with a coating of pigmented layer superimposed with a layer of a reflective material and one or more layers of a fluorescent material to generate the desired colored light when the lamp is energized. The logo or design is laser engraved onto the glass envelope of the lamp is a manner to ablate the respective layers of material wherever the laser beam engages the glass envelope. The arrangement is such that when the lamp is energized, the logo or design will be illuminated in the color of the light generated by the fluorescent material associated with the logo or design. In one form of the invention, multiple color light is generated by layering multiple coatings of fluorescent material internally of a lamp wherein each layer of fluorescent material will generate light of different colors. In another form, the various color light is produced by a plurality of fluorescent bands formed internally of the lamp, each band being formed by a different fluorescent material.

11 Claims, 8 Drawing Sheets

FLUORESCENT LAMPS WITH IMPRINTED COLOR LOGOS AND METHOD OF MAKING SAME

FIELD OF INVENTION

This invention relates generally to fluorescent lamps and more specifically to fluorescent lamps bearing colored and/or multi-colored logos and the method of making the same.

PRIOR ART

Heretofore, fluorescent lamps have been primarily useful solely for lighting purposes. Such fluorescent lamps were not used as direct displays, advertisements and/or for the communicating of information. Generally, lighted displays used in advertising and/or for communicating information comprised the so-called neon signs in which the glass envelope was shaped to define given letters, words or designs which would then be energized to form the lighted display or sign. Other illuminated signs, displays and the like were comprised of a housing containing an incandescent or fluorescent lighting fixture to illuminate a front translucent or transparent panel on which the advertising message, sign or other information is presented, and which panel is illuminated whenever the background conventional lighting source behind the panel was energized.

An object of this invention is to provide a new and novel form of communication medium utilizing a fluorescent lamp constructed and arranged so that a predetermined logo, design or other information appears directly on the surface of the fluorescent lamp when the lamp is energized.

Another object is to provide a fluorescent lamp having directly imprinted thereon various logos, designs, words and/or other graphic information which are illuminated in color or multi-colors when the lamp is energized.

Another object is to provide a method of making a fluorescent lamp having colored and/or multi-colored designs, logos, and/or other desired information formed thereon, which become illuminated whenever the lamp is energized.

Another object is to provide for a method of band coating the interior of a fluorescent lamp with multiple circumscribing bands of variously colored fluorescent coatings to form various color bands of light when energized.

Another object is to provide for a method of coating the interior of a fluorescent glass tube with multiple layers of variously colored fluorescent coatings which are externally engraved to define a specific logo, design, or other information which is illuminated in the color of an associated fluorescent coating when the fluorescent lamp is energized.

Another object is to provide a fluorescent lamp having formed thereon a logo or a series of logos, designs, words or other graphic material that are illuminated in the same color or in multiple colors whenever the lamp is energized, depending upon the interior fluorescent coating of the lamp.

Another object is to provide an improved means and method of coating the interior surface of a fluorescent lamp for producing colored and/or multi-colored logos, designs, words and/or other graphic material to appear directly on the surface of the fluorescent lamp.

SUMMARY OF THE INVENTION

The foregoing objects, features and other advantages of this invention are attained by coating the interior of a glass tube or envelope of a fluorescent lamp with a first layer of a pigmented coating which effectively renders the glass envelope or tube light opaque. Thereafter, the pigmented layer or coating has superimposed thereon a second layer or coating of a reflective material. One or more layers or coatings of a fluorescent material are superimposed upon the coating or layer of reflective material previously deposited upon the pigmented coating, each layer of fluorescent material being formulated to generate or emit light of a different color, e.g. red, yellow, blue or other color. In accordance with this invention, the fluorescent coatings may be formed as a series of superimposed layers circumscribing the glass tube or envelope along the length thereof, or may be formed as a series of successive bands, each band extending over only a segmental portion of the tube or envelope along the length thereof and capable of emitting a different colored light. The various fluorescent layers or bands may be formed by rolling, spraying, or by electrostatic deposit.

A suitable logo, design, or other graphic information is formed by subjecting the coated tube to a laser engraving device which is programmed to form the desired logo, design or graphic information by directing an external laser beam onto the glass tube which is focused to ablate the underlying coatings. Thus, the laser beam acting on the surface of the glass tubes causes the ablation of the underlying coatings to produce the desired logo or image on the glass tube. The laser engraving can be formed either before or after the fluorescent coating is applied to the glass tube. The lamp is thereafter completed in the conventional manner. In use, when the lamp is energized, the light generated is directed to the laser engraved logos or designs formed on the lamp, thereby lighting the logos or designs in the color emitted by the fluorescent coating associated with the given logo or designs. The effect is colorful, interesting and intriguing so as to impart an attractive, novel and eye-catching appeal to the lighted logos, designs, or graphic information appearing on the surface of the fluorescent lamp.

IN THE DRAWINGS

DETAILED DESCRIPTION

Figure 6:
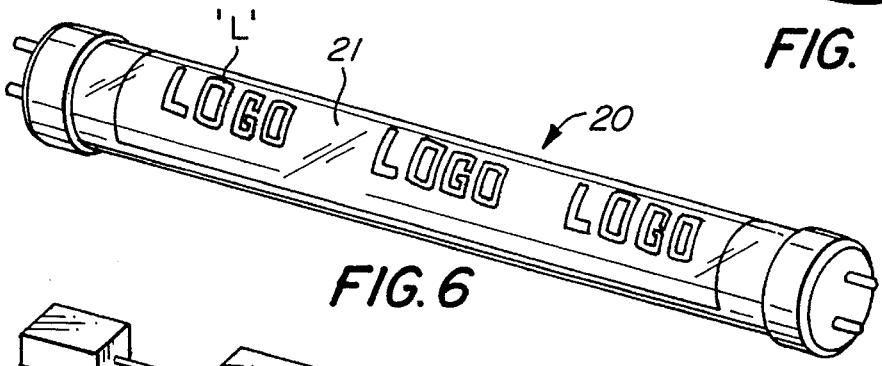
FIG. 6 is a perspective view of a completed fluorescent lamp embodying the invention.
Figure 7:
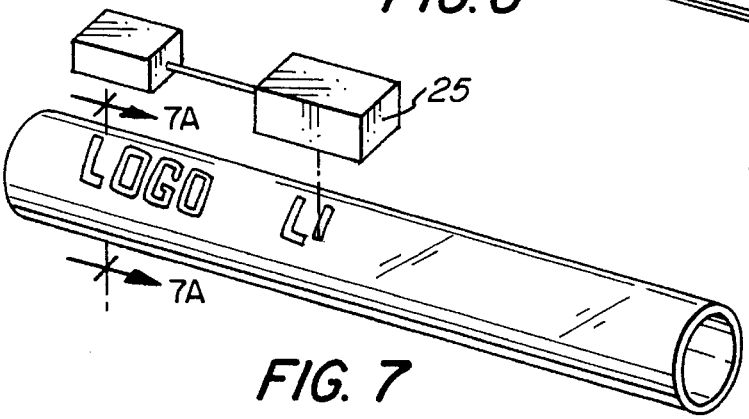
FIG. 7 is a perspective view of a glass tube illustrating a slightly modified form of the invention.
Figure 7A:
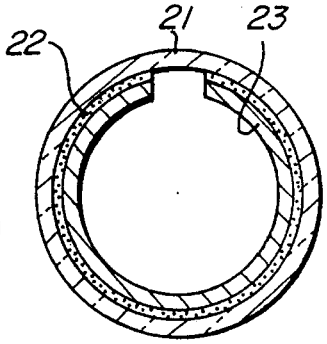
FIG. 7A is a sectional view taken along line 7A—7A on FIG. 7.

Referring to the drawings, there is shown in FIG. 6 a fluorescent lamp 20 embodying the present invention. As shown, the lamp 20 comprises an elongated glass tube or envelope 21 having formed thereon one or more logos "L" which, when the lamp 20 is energized, will become illuminated. The arrangement is such that the logos "L" will brilliantly light up when the lamp is energized, thereby rendering the logos "L" the prominent illuminated feature that will appear to the eye of the viewer. The remainder portion of the lamp will appear unlighted. "Logo" as used and defined herein, means any word, design, trademarks, slogan or any other graphic representation. In accordance with this invention, the logos "L" may be illuminated with a light of the same color or of different colors. As will be hereinafter described, the color of the light illuminating a given logo or logos "L" formed on the lamp 20 will correspond to the color of light emitted by a given fluorescent coating utilized in the construction of the fluorescent lamp. Fluorescent coatings are generally formulated so that when excited by UV radiation, they will emit light of a predetermined color. Such fluorescent materials are well known. As will be described, the internal surface of the fluorescent glass tube 21 is coated with a layer of fluorescent material formulated to emit a light of a predetermined color or in different colors.

Figure 1:
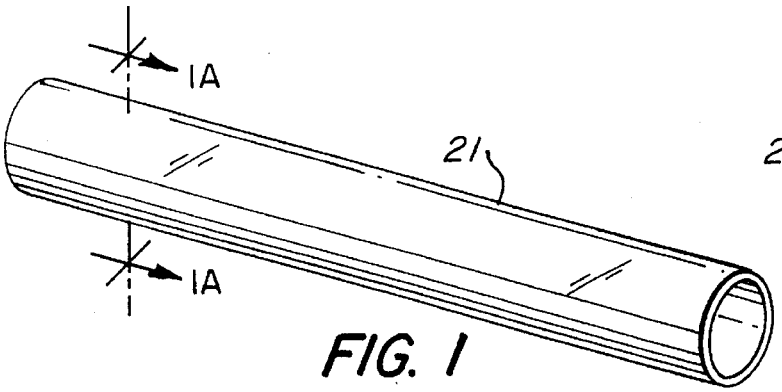
FIG. 1 is a perspective view of a glass tube or envelope of a fluorescent lamp.
Figure 1A:
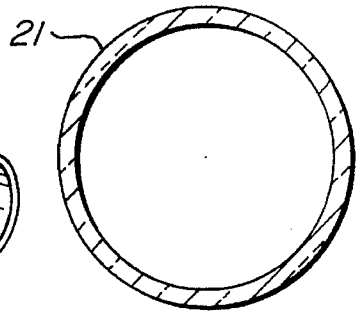
FIG. 1A is a sectional view of the glass envelope taken along line 1A—1A on FIG. 1.
Figure 2:
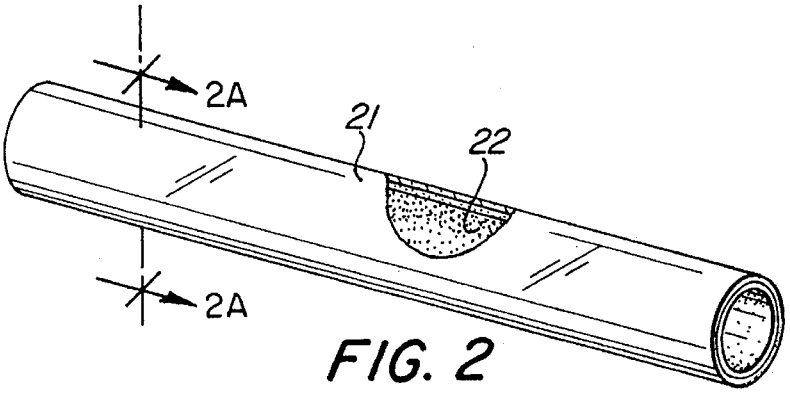
FIG. 2 is a perspective view of a glass tube of a fluorescent lamp coated with a pigmented layer or coating on the interior surface thereof and having a portion broken away.
Figure 2A:
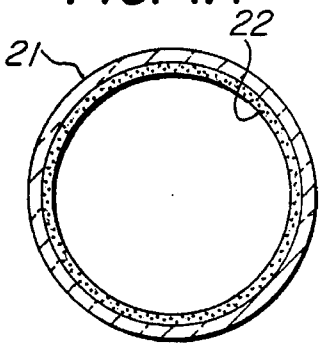
FIG. 2A is a cross sectional view taken along line 2A—2A on FIG. 2.
Figure 3:
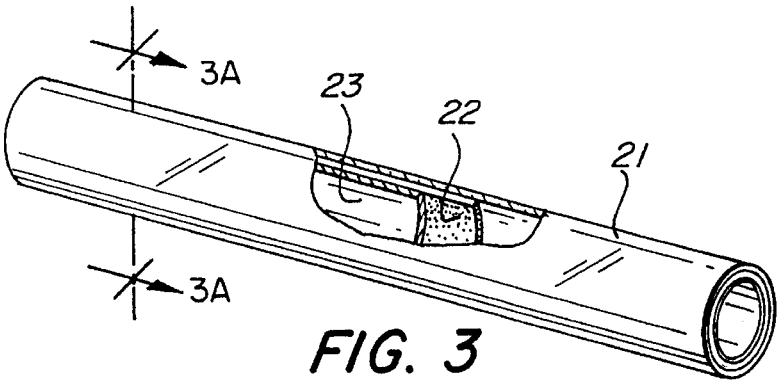
FIG. 3 is a perspective view of a glass tube of a fluorescent lamp illustrating the intermediate step of a reflective coating superimposed on the pigmented layer, and having a portion broken away.
Figure 3A:
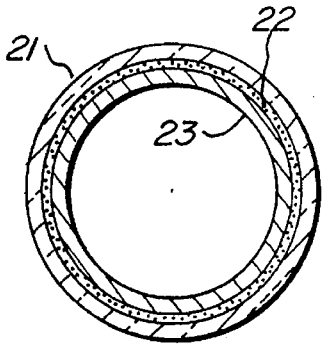
FIG. 3A is a sectional view taken along line 3A—3A on FIG. 3.

FIG. 1 illustrates a length of a glass tube or envelope 21 utilized in making a fluorescent lamp 20 embodying the invention. Such glass tubes 21 are generally formed of a clear or transparent glass. As shown in FIG. 2, the internal surface of the tube 21 is first coated with a ceramic colored pigment to define a pigmented layer 22 over substantially the entire internal surface of the tube. The ceramic pigmented layer 22 is fixed to the internal surface of the tube 21 by baking, i.e. subjecting the tube to heat sufficient to adhere the pigmented layer 22 to the internal surface of the tube 21. For example, the pigmented layer can be baked at a temperature of about 500° C. for approximately one minute. After the baking or fixing of the ceramic pigmented coating 22 to the internal surface of the tube, a coating 23 of a suitable reflective material is superimposed over the ceramic pigmented layer 22 as shown in FIG. 3. Such reflective coating may be comprised of magnesium oxide, titanium oxide or the like. The reflective coating 23 is also fixed by a baking or heating step, as described.

Upon completion of the second baking or fixing of the reflective coating 23 in place, a third coating 24 of a suitable fluorescent material is superimposed over the reflective coating 23, and which fluorescent coating is also subjected to a baking step. As will be hereinafter described, the third or fluorescent coating 24 may comprise either a fluorescent material that will emit light in only one color, or the fluorescent coating 24 may be formed as a series of layers or as a series of bands juxtaposed along the length of the tube 21 wherein each layer or band of fluorescent material will emit a different colored light to illuminate an associated logo L.

Figure 4:
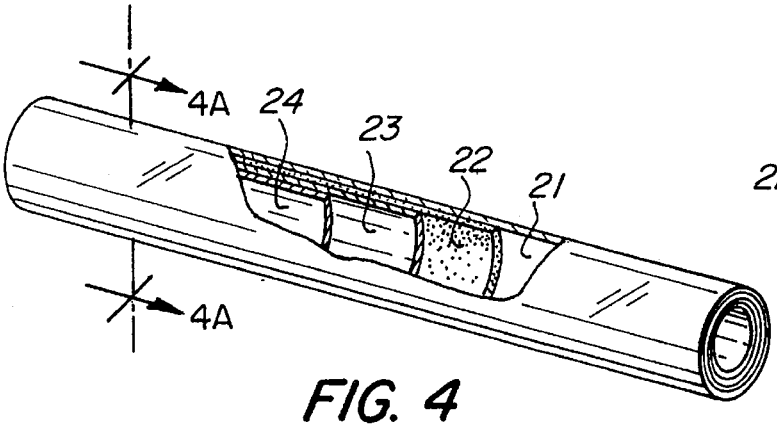
FIG. 4 is a perspective view of a glass tube of a fluorescent lamp illustrating the intermediate step of a fluorescent coating superimposed onto the reflective layer, and having a portion broken away.
Figure 4A:
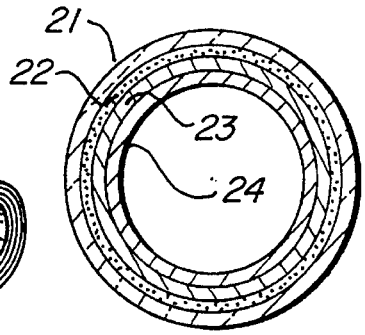
FIG. 4A is a sectional view taken along line 4A—4A on FIG. 4.

FIGS. 4 and 4A illustrate a glass tube 21 formed with successive layers comprising a pigmented coating 22 superimposed by a reflective layer 23 which in turn is superimposed with a fluorescent layer 24. It will be understood that the respective layers 22, 23, and 24 are also fixed by baking and/or the application of heat, e.g. as herein described.

Figure 5:
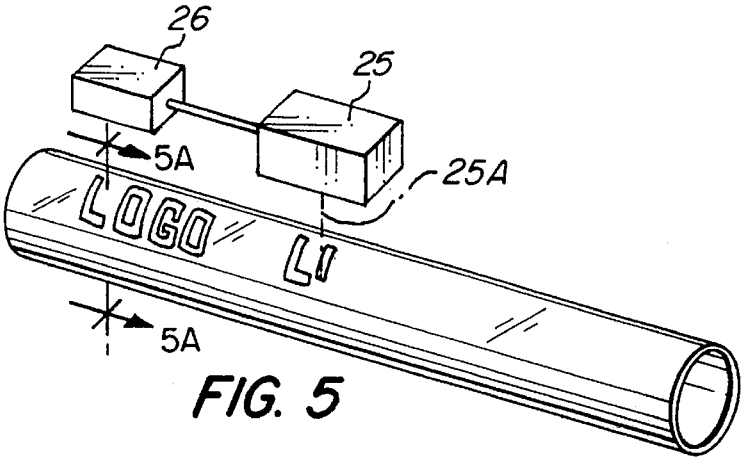
FIG. 5 is a diagrammatic perspective view of a glass tube of a fluorescent lamp illustrating the laser engraving of a logo.
Figure 5A:
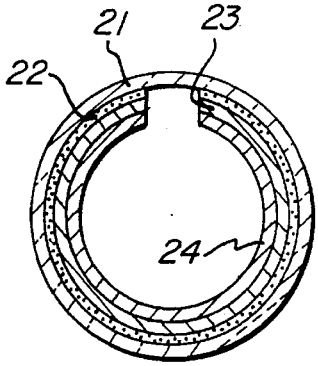
FIG. 5A is a sectional view taken along line 5A—5A on FIG. 5.

After the tube 21 has been coated as hereinbefore described, a desired logo is engraved onto the tube 21. In accordance with this invention, the desired logo is engraved by a laser 25 as shown in FIG. 5. The laser 25, such as a YAG laser having a wave length of 1064 nanometers and a power of approximately 40 watts, is controlled by a computer 26 whereby the laser beam 25A, impinging upon the surface of the tube 21, is focused so as to cause ablation of the subjacent coatings wherever the laser beam impinges on the surface of the tube 21. The desired logo, design or graphic information that is programmed into the computer controls the path of the laser beam so as to engrave the programmed logo onto the tube. FIG. 5A illustrates the manner in which the underlying layers 22, 23 and 24 are ablated by the laser beam. As shown in FIG. 5A, the area of the logo formed by the laser beam 25A is free of any coating material. After the laser engraving has been completed, the residue resulting from the ablation of the coatings is cleaned out of the tube, e.g. by blowing an inert gas therethrough to purge any residue, and the construction of the lamp is thereafter completed in the conventional manner. FIG. 6 illustrates the completed fluorescent lamp 20 as herein described. Thus, when the lamp 20 of FIG. 6 is energized, the respective logo or logos "L" will become illuminated by the reflection of light being emitted from the fluorescent coating on the surface directly opposite the logo "L", and in the color of the light generated by the given fluorescent coating.

Figure 8:
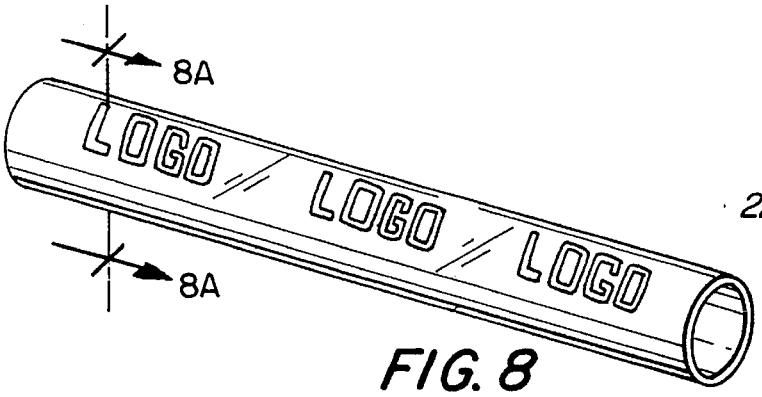
FIG. 8 is a perspective view of a glass tube of the modified version of FIG. 7 illustrating the fluorescent coating.
Figure 8A:
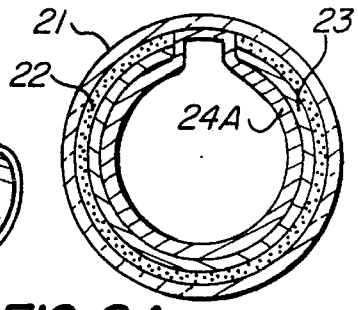
FIG. 8A is a sectional view taken along line 8A—8A on FIG. 8.

In a modified form of the invention, as shown in FIG. 8, the logo "L" is laser engraved onto the tube 21 after the reflective coating 23 has been applied as hereinbefore described, and before the fluorescent coating 24 is applied. As shown in FIG. 8A, the laser ablation occurs only in the pigmented layer 21 and the reflective layer 22. In this form of the invention, the fluorescent coating or layer 24A is applied after the laser engraving of the logo L has been accomplished. It will be noted that the application of the fluorescent coating 24A to the internal surface of the tube 21 in this form of the invention will cause the fluorescent material to form a coating directly onto the "window" formed by the logo engraving of the tube, as best seen in FIG. 8A. After baking the fluorescent layer 24A in this form of the invention, the fluorescent lamp is completed in the conventional manner. In this form of the invention, the lamp, when energized, causes the respective logos "L" to be directly lighted by the fluorescent coating 24A coated over the "window" defined by the respective logo. The remainder of the lamp tube will appear unlighted because of the pigmented coating 21. Thus, only the engraved logo portion of the lamp appears illuminated.

FIGS. 9 to 12 illustrate another form of the invention wherein the fluorescent coating is applied to the glass tube in a series of circumscribing bands wherein each fluorescent coating or band will emit a different colored light. In this way, the logos associated with each such band will appear, when the lamp is energized, in a different color.

Figure 9:
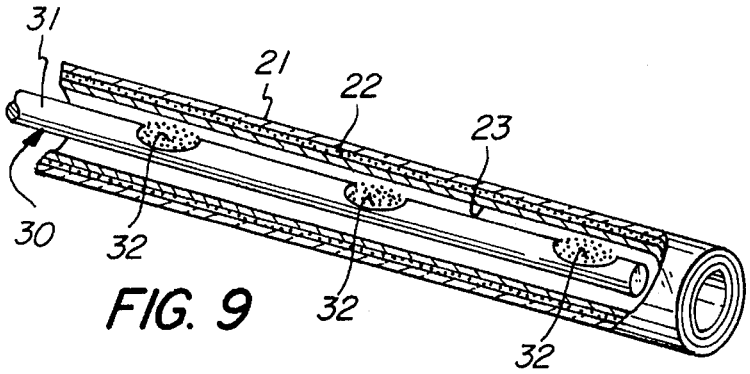
FIG. 9 is a perspective view illustrating a means of applying multiple colored fluorescent coatings for forming a plurality of circumscribing bands to the interior of a fluorescent glass tube or envelope.
Figure 9A:
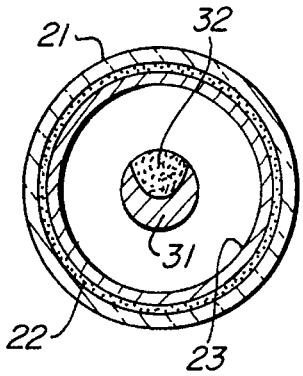
FIG. 9A is a sectional view taken on line 9A—9A on FIG. 9.

As shown in FIG. 9, the glass tube or envelope 21 is first coated with a pigmented color layer 22 along the interior surface thereof and which is fixed thereto by baking, as hereinbefore described. The reflective coating 23 is thereafter superimposed onto the pigmented layer 22, also as hereinbefore described. To form the series of band coating of various fluorescent materials, a means 30 in the form of an elongated holder 31 for fluorescent material is provided. The fluorescent material holder 31 is provided with a plurality of spaced apart pockets 32, each pocket 32 being sized to receive a predetermined amount of a fluorescent material sufficient to form one band as will be herein described. It will be understood that the fluorescent material deposited in each of the pockets may be of the type that will emit a different colored light.

In accordance with this invention, the holder 31 with the fluorescent material placed in each of the pockets 32 is positioned to be received in a horizontally disposed glass tube 21 as shown in FIG. 9. The holder 31 is also mounted for rotation by a suitable means (not shown) so that by rotating the holder 180° to a position shown in FIG. 10, the fluorescent material is discharged from the respective pockets 32 and deposited onto the glass tube. In this position, the horizontal glass tube 21 is then rotated by means not shown so that the fluorescent material will coat the interior of the glass tube in a limited band width as best seen in FIG. 11. To accomplish this result, the glass tube 21 must be maintained in a horizontal position as it is rotated to circumferentially spread the fluorescent material deposited onto the glass tube about the interior surface of the glass tube. Upon the formation of the various color bands, e.g. A, B and C on the interior surface of the tube 21, the bands of fluorescent coatings so formed are then fixed to the glass tube 21 by baking as hereinbefore described. It will be understood that each band width A, B, C of fluorescent coating is formed of a fluorescent material that will emit a different colored light. For example, the fluorescent bands A, B, C may be selected to emit any color combination, e.g. red, green and blue or any other suitable color combination. While three bands of fluorescent coating are illustrated, it will be understood that the number of bands formed on the interior of a glass tube 21 may be varied as desired.

Figure 10:
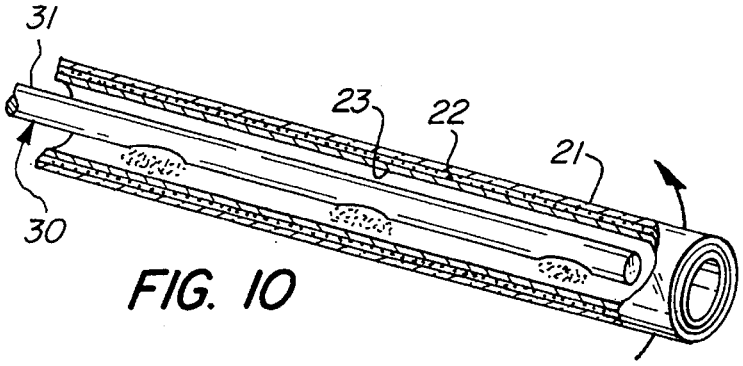
FIG. 10 is a view similar to that of FIG. 9 illustrating the deposit of the fluorescent material in the glass tube prior to the forming of the bands.
Figure 10A:
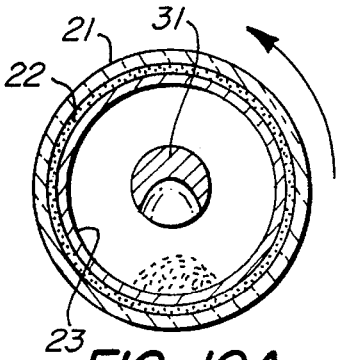
Figure 11:
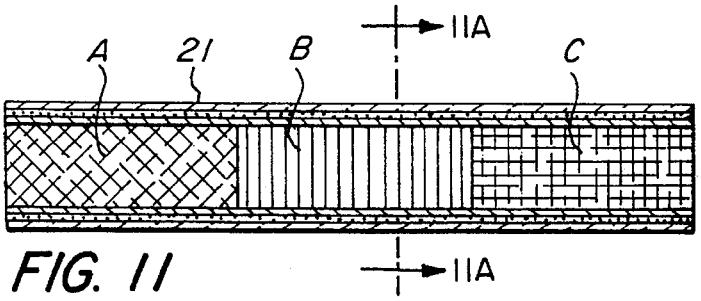
FIG. 11 is a longitudinal sectional view of a fluorescent glass tube of FIGS. 9 and 10 illustrating multiple bands of various color coating of fluorescent material formed on the interior of the glass tube.
Figure 11A:
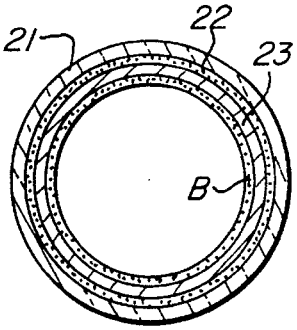
FIG. 11A is a sectional view taken along line 11A—11A on FIG. 11.
Figure 12:
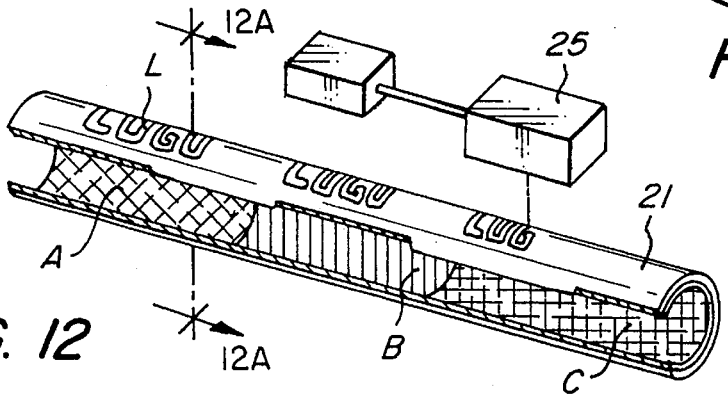
FIG. 12 illustrates the step of laser engraving the logo on the glass tube of FIG. 11.
Figure 12A:
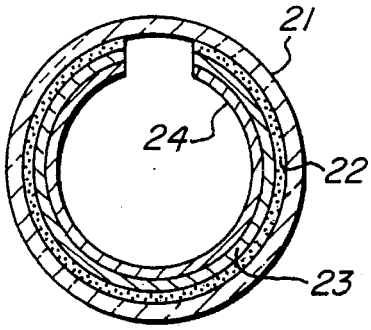
FIG. 12A is a cross section view taken on line 12A—12A on FIG. 12.

After the glass tube 21 has been coated as described with respect to FIGS. 9 to 11, the logo or logos "L" are laser engraved as hereinbefore described. As best seen in FIGS. 12 and 12A, each color band width A, B, and C may be provided with a given logo engraving. Referring to FIG. 12A, the laser engraving will ablate each layer of coating superimposed on the internal surface of the glass tube 21. Thus, when the lamp is energized, the logo or "window" defined thereby will be illuminated in the color of the light being reflected by the coating of fluorescent material A, B, and C opposite the respective logo "L" or "window".

Figure 12B:
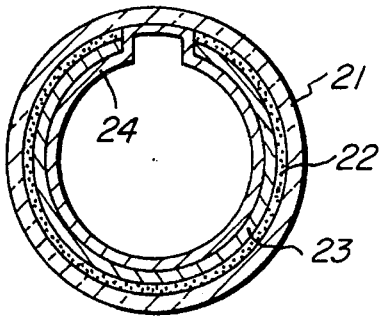
FIG. 12B is a modified form of the invention.

In a slightly modified embodiment as seen in FIG. 12B, the fluorescent coating or bands A, B, and C may be formed after the laser engraving step. In other words, the glass tube 21 is coated with a pigmented layer 22 as hereinbefore described with respect to FIG. 9, and which coating is then superimposed by a coating of the reflective layer 23 as hereinbefore described. The laser engraving is then performed whereby the pigmented layer 22 and reflective layer 23 are ablated wherever the laser beam has traversed the glass tube to form the desired logo L. The fluorescent coating bands A, B, and C are then formed and fixed to the glass tube so that the fluorescent coating is applied directly to the engraved portion or "window" defined by the logo "L"; as best seen in FIG. 12B. In this form, the illumination of the logo L is effected directly by the fluorescent coating immediately contiguous to or coating the "window" defined by the logo.

Figure 13:
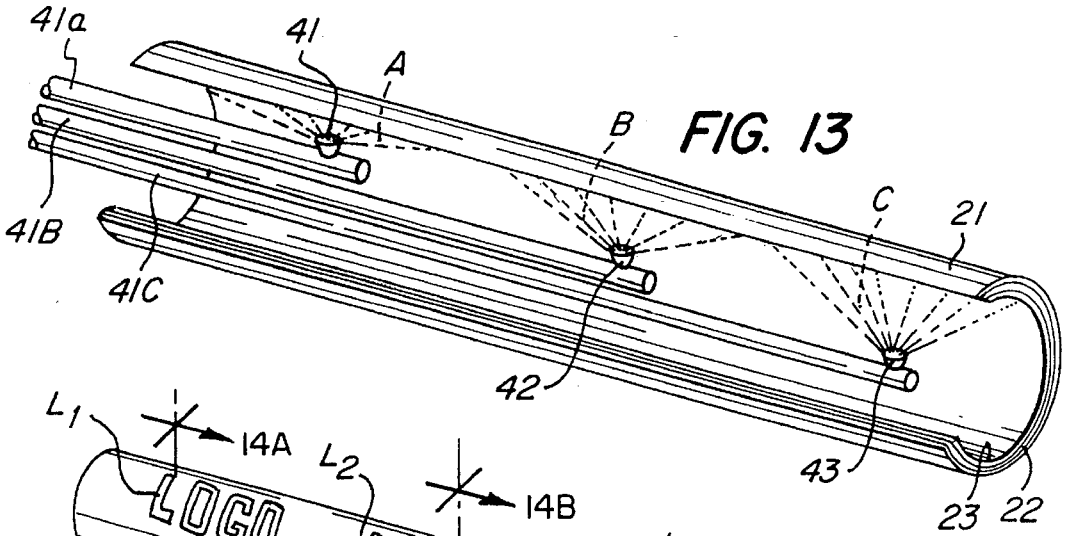
FIG. 13 illustrates another form of the invention in which the multi-color bands are formed by spraying.

FIG. 13 illustrates another embodiment of the invention. In this form of the invention, the various color bands of fluorescent material as hereinbefore described may be formed by spraying. It will be understood that prior to spraying the color bands of fluorescent material, the glass tube 21 is first coated with a layer of pigmented material 22 as hereinbefore described, and which coating is then superimposed with the second or reflective coating 23, as hereinbefore described.

As shown in FIG. 13, the glass tube 21, after being coated with the pigmented layer 22 and reflective coating 23 is positioned to receive spray nozzles 41, 42, 43. Each of the spray nozzles 41, 42, and 43 are connected to corresponding conduits 41A, 42A, and 43A, which in turn are connected into communication with a source of the fluorescent material. To coat the fluorescent material in contiguous bands A, B, and C, the glass tube 21 is rotated relative to the spray nozzles 41, 42, and 43. Conversely, the spray nozzles 41, 42, and 43 may be rotated relative to the glass tube 21. The relative rotation between the glass tube 21 and the spray nozzles 41, 42, and 43 results in the forming of a band of a desired fluorescent coating on the interior of the glass tube. After baking of the fluorescent coating, the coated glass tube 21 may then be laser engraved, as herein described, to form the desired logo L either before or after the fluorescent coating is applied, depending upon whether the logo is desired to be directly or indirectly illuminated when the lamp is energized as described, e.g. with respect to FIGS. 12A and 12B.

In yet another form of the invention, the fluorescent bands A, B, and C may be formed by depositing the selected colored fluorescent material onto the glass tube by an electrostatic method. In this form of the invention, the fluorescent material is electrically charged so that when an electrostatic field is formed exteriorly of the glass tube, the charged particles of the fluorescent material are attached to and deposited onto the interior surface of the glass tube, which have been previously coated with the pigmented coating and reflective coating as hereinbefore described.

Figure 14:
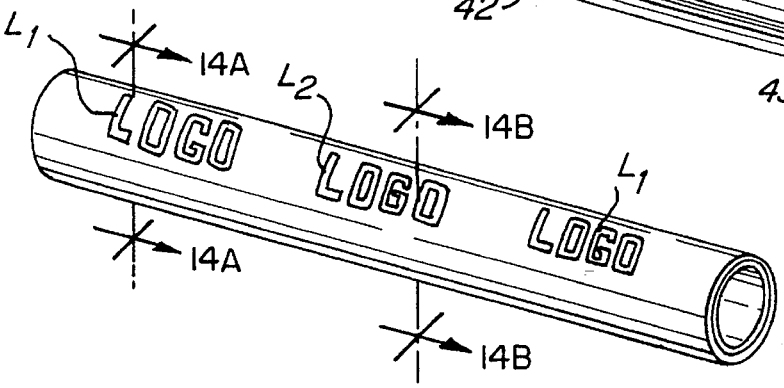
FIG. 14 illustrates another form of the invention.
Figure 14B:
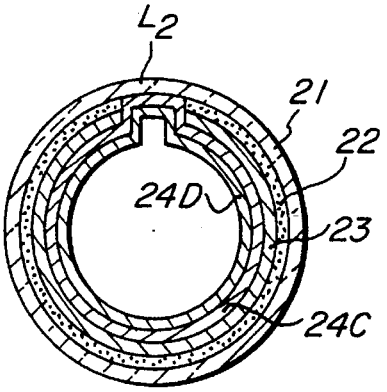
FIG. 14B is a sectional view taken on line 14B—14B on FIG. 14.
Figure 14A:
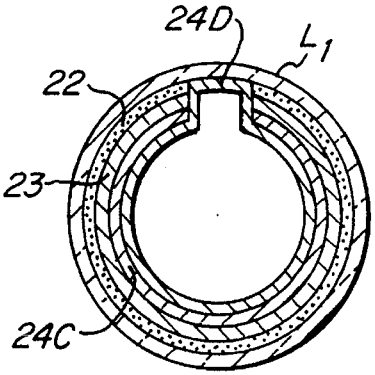
FIG. 14A is a sectional view taken on line 14A—14A on FIG. 14.
Figure 15:
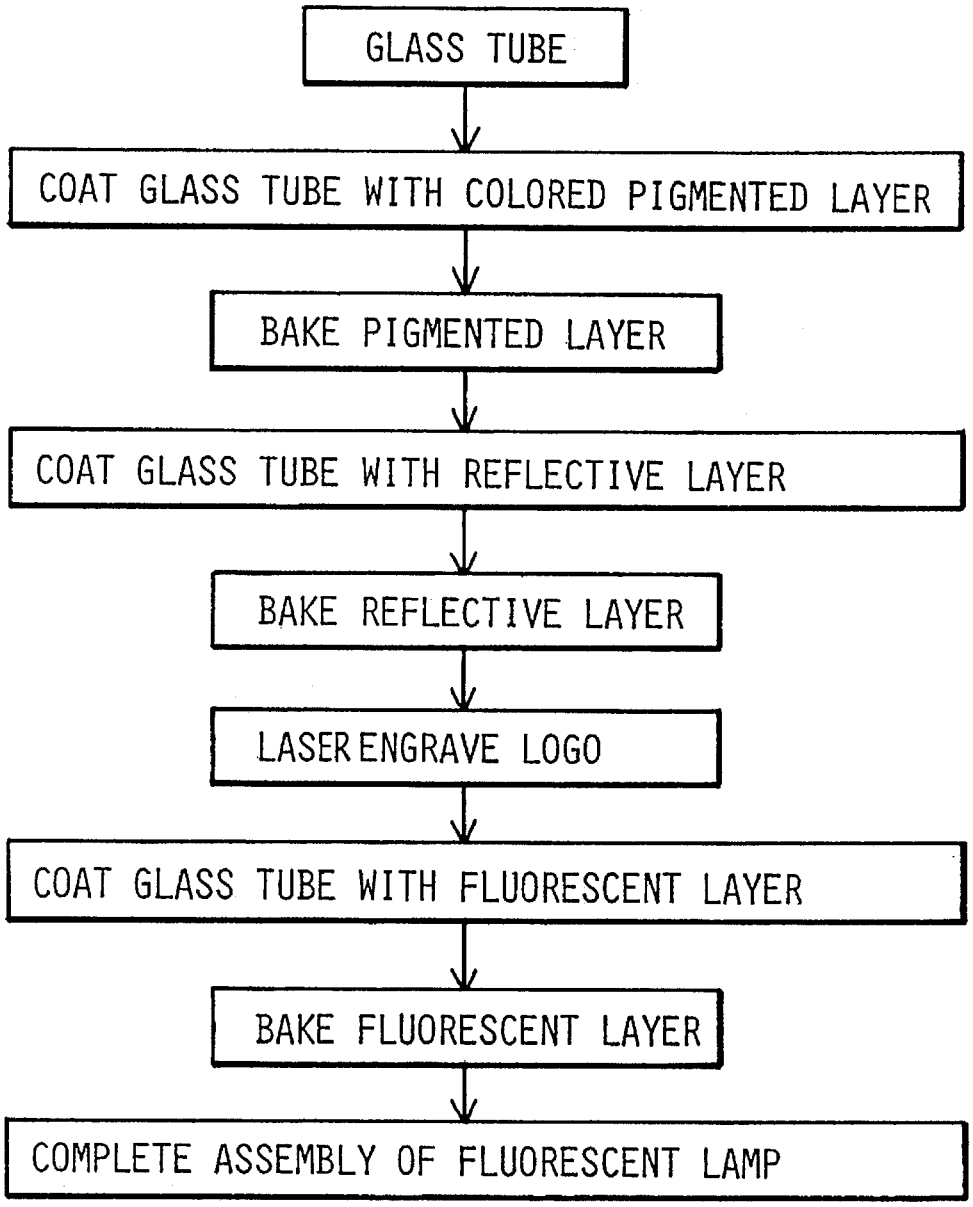
FIG. 15 is a diagrammatic chart illustrating the method steps in one form of the invention.
Figure 16:
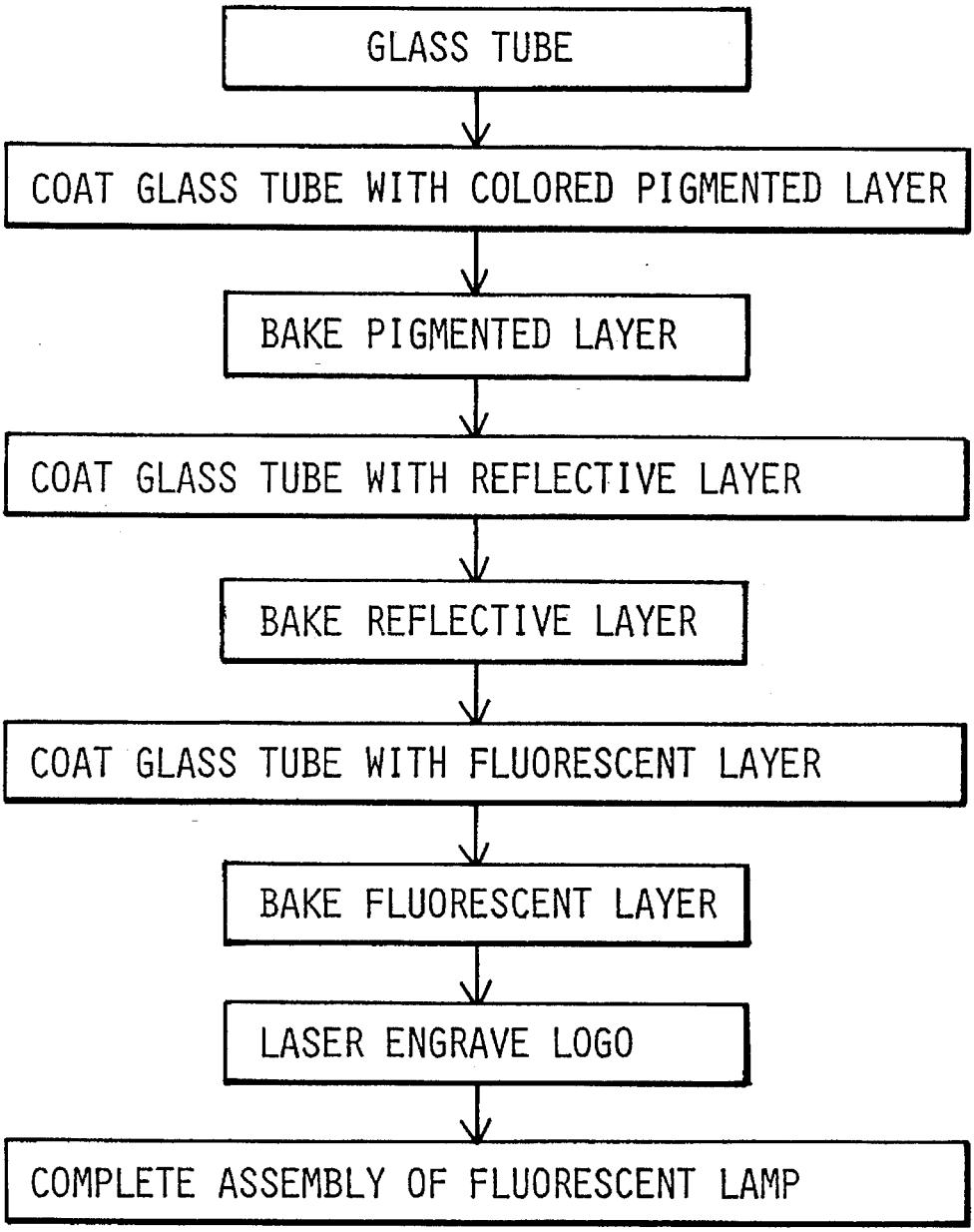
FIG. 16 is a diagrammatic chart illustrating the steps of a modified method.
Figure 17:
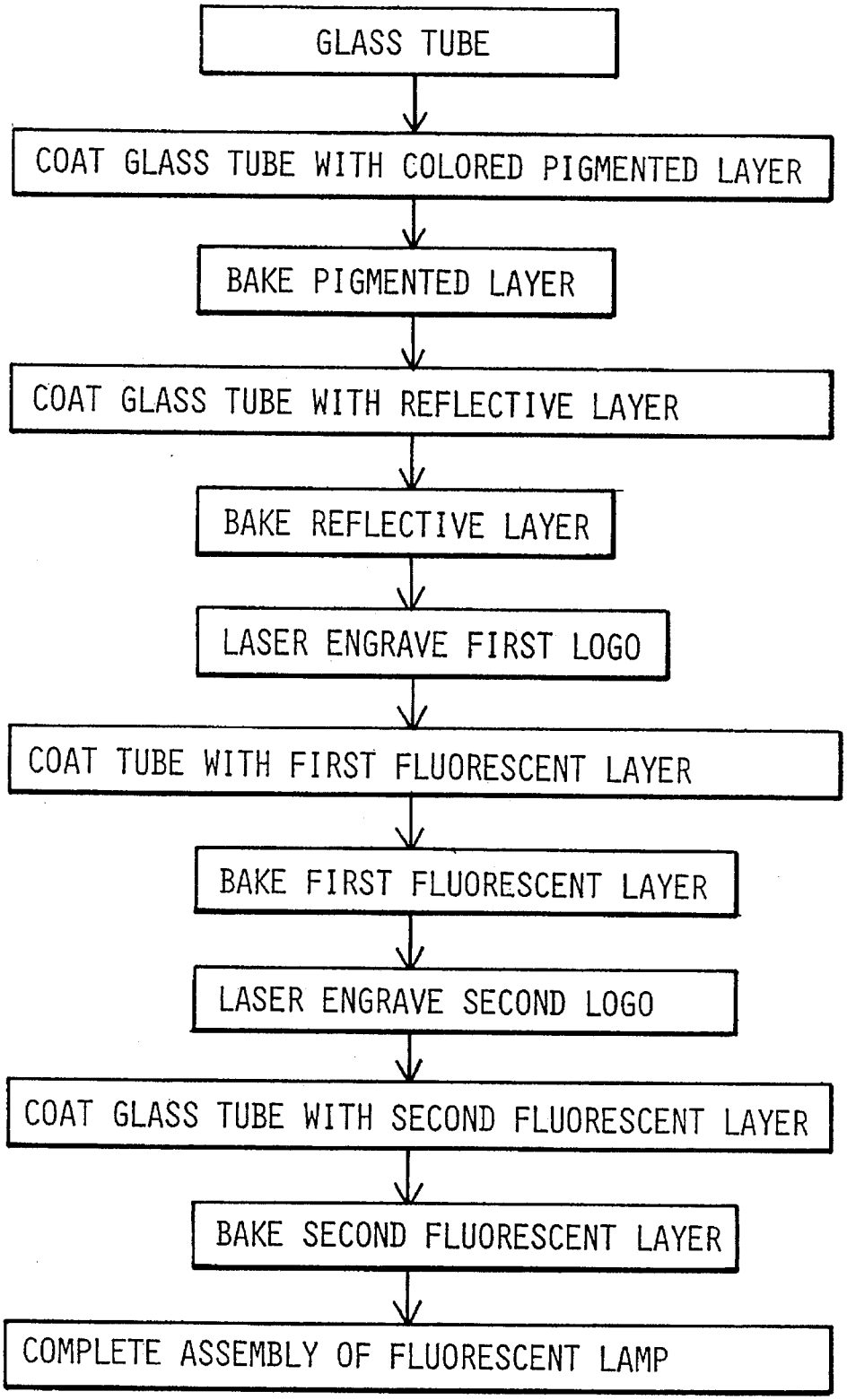
FIG. 17 is a diagrammatic chart illustrating the steps of another modified method.
Figure 18:
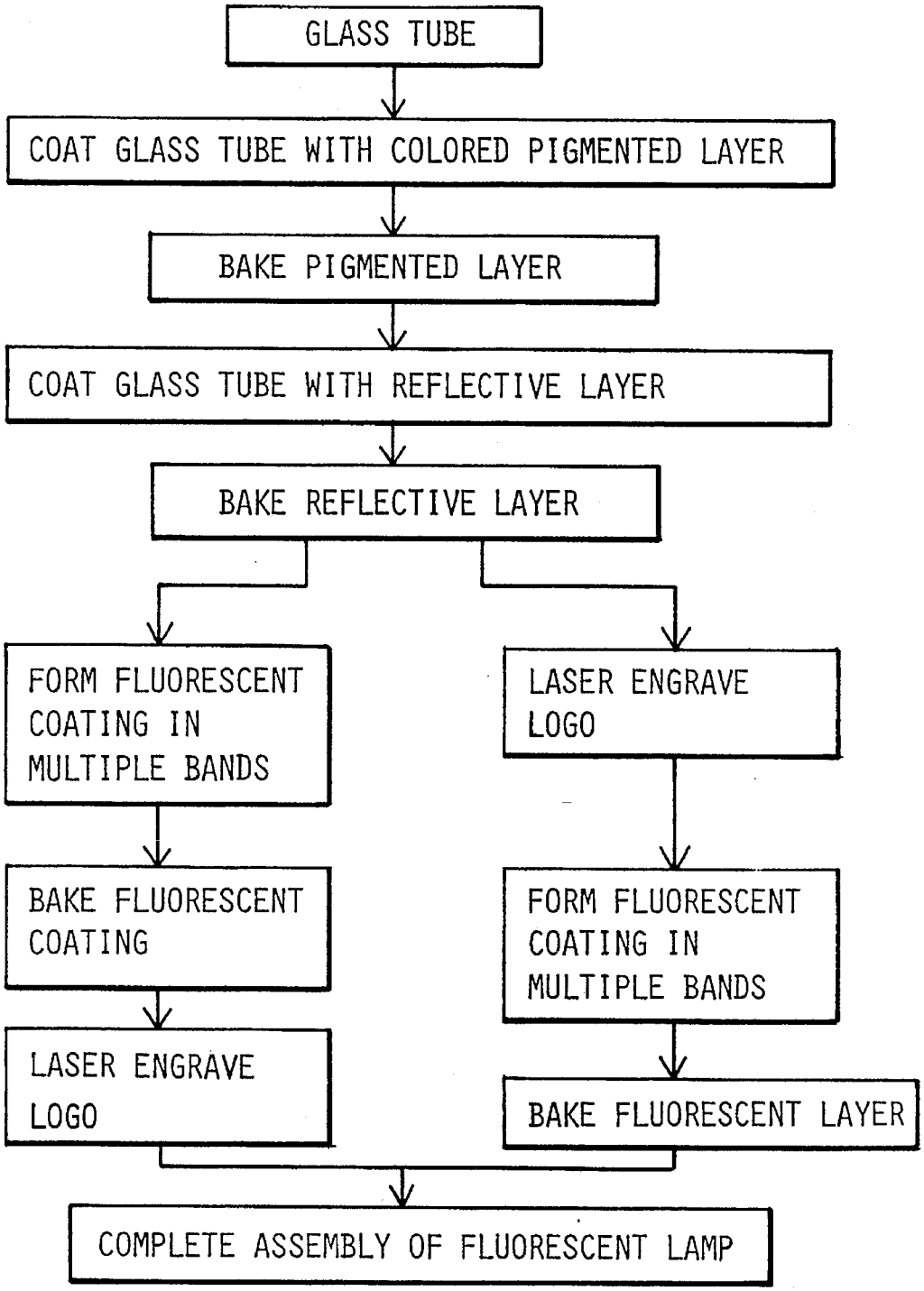
FIG. 18 is a diagrammatic chart illustrating the steps of another modified method.

FIGS. 14, 14A and 14B illustrate further embodiments of the invention. In FIG. 14, the glass tube 21 is coated with multiple layers of a fluorescent material, each layer of fluorescent material formulated to emit a different colored light to an associated logo. This is attained by first coating the interior surface of a glass tube 21 with a ceramic pigmented coating 22 as hereinbefore described. A reflective coating 23 is thereafter applied over the pigmented coating 22, also as hereinbefore described. At least one logo "$L_1$" is then laser engraved as hereinbefore described to ablate the underlying pigmented layer and reflective layer. In the illustrated embodiment of FIG. 14, every other logo $L_1$ is so laser engraved. A first layer of a fluorescent coating 24C capable of emitting a light of a predetermined color is then applied over the reflective coating 23 and the "window" portions of the engraved logos, e.g. "$L_1$", and fixed thereto by baking as hereinbefore described. A second logo $L_2$ is then laser engraved to ablate the pigmented layer 22, reflective layer 23, and the first fluorescent layer 24C. A second layer of a fluorescent material 24D capable of emitting a different colored light is then superimposed over the first layer of fluorescent material 24C. It will be understood that the superimposed fluorescent layers 24C and 24D cover the internal surface of the glass tube and the respective "windows" of logos $L_1$ as shown in FIG. 14A. As best seen in FIG. 14B, the second laser engraving of logo $L_2$ will ablate coatings 22, 23, and 24C to form a "window" defining logo $L_2$. The second coating 24D of fluorescent material, coating over the window of logo $L_2$, is selected to emit a light color different from that of the first coating 24C. It will be understood that additional layers of fluorescent coating may be applied depending upon the number of different logos or colors desired. Thus, logo $L_1$ is backed by fluorescent layers 24C and 24D while logo $L_2$ is backed by fluorescent layer 24D. It will also be understood that logo $L_2$ may be laser engraved either before or after the second fluorescent coating is applied. If logo $L_2$ is laser engraved after the application of the second coating or layer 24D, the logo $L_2$ will be illuminated by the reflective light of the second fluorescent coating 24D directly opposite the window defined by logo $L_2$.

In this form of the invention, whenever the fluorescent lamp is energized, each logo will be illuminated in the color of the fluorescent layer or layers associated with a given logo. For example, in the illustrated embodiment of FIG. 14, logos $L_1$ may be illuminated in a color blend made up by the colors of fluorescent layers 24C and 24D, while logo $L_2$ will be illuminated by the color of light emitted only by fluorescent coating 24D adjacent or opposite the "window" of logo $L_2$ as seen in FIG. 14B.

From the foregoing, it will be apparent that a novel and unique fluorescent lamp and method of making the same is achieved which is particularly useful as a means of communicating information to the general public. The logos imprinted upon the lamp as herein described may be illuminated in one or more colors when the lamp is energized. Because of the pigmented layer 22 initially deposited on the internal surface of the glass tube, only the logo portion L will appear illuminated, making the appeal to the eye attractive and unique. The multiple color effect is achieved either by a series of bands of fluorescent material capable of emitting a different color formed along the internal surface of the glass tube 21 or by one or more layers of fluorescent material 24C and 24D superimposed on the internal surface of the glass tube wherein the laser engraving of the desired logos may be sequentially performed in alternate steps to the placing of the variously colored layers of fluorescent material, as herein described.

The fluorescent materials herein referred to are manufactured by various companies and can be secured in various colors, e.g. Sylvania manufactures such materials such as a green consisting of $Zn_2SiO_4$:Mn; a red consisting of $Y_2O_3$; Eu and many other colors.

While the invention has been described with respect to particular embodiments thereof, it will be understood and appreciated that variations and modifications may be made without departing from the spirit or scope of the invention.

What is claimed is:

1. A fluorescent lamp comprising:

an elongated glass tube, an internal light opaque coating formed on the internal surface of said glass tube, a coating of fluorescent material for emitting a variable colored light superimposed over said internal opaque coating, a logo communicating a message formed directly in said internal coating formed on the internal surface of said glass tube, and means for illuminating said logo in variable colors when the lamp is energized whereby only said logo appears illuminated.

2. A fluorescent lamp comprising:

a glass tube, a layer of light opaque pigmented coating covering the internal surface of said glass tube, a reflective layer superimposed upon said light opaque pigmented coating, a layer of fluorescent material superimposed onto said reflective layer, and a logo communicating a message directly formed in at least said light opaque pigmented coating and superimposed reflective layer on the internal surface of said glass tube, said logo being illuminated by the light generated by said fluorescent material when the lamp is energized, whereby only said logo is illuminated.

3. A fluorescent lamp as defined in claim 2 wherein the layer of the pigmented coating, the reflective layer and the layer of the fluorescent material are ablated to form said logo directly in said superimposed layers.

4. A fluorescent lamp as defined in claim 2 wherein only the pigmented coating and reflective coating are ablated to form said logo in said pigmented coating and reflective layer to define a window.

5. A fluorescent lamp as defined in claim 2 wherein said logo is formed by laser engraving.

6. A fluorescent lamp comprising:

an elongated glass tube, a layer of a light opaque pigmented coating covering the internal surface of said glass tube, a reflective layer superimposed upon said pigmented coating, a fluorescent layer superimposed upon said reflective layer, said fluorescent layer including a plurality of bands circumscribing said glass tube internally thereof, said bands being formed of a different fluorescent material for emitting a different colored light, said bands extending along the length of said glass tube, and a logo formed directly in said layers by the ablation of at least two of said layers to define a predetermined design communicating a message in variable colors in accordance to the color emitted by said bands, when said lamp is energized.

7. A fluorescent lamp as defined in claim 6 wherein a logo is associated with each of said bands of said fluorescent layer.

8. A fluorescent lamp as defined in claim 6 wherein said logo is defined by a predetermined ablated portion of said pigmented and reflective layers only.

9. A fluorescent lamp as defined in claim 8 wherein said fluorescent material covers the ablated portion of said pigmented and reflective layers defining said logo.

10. A fluorescent lamp as defined in claim 6 wherein said logo comprises a predetermined ablation of said pigmented, reflective and fluorescent layers.

11. A fluorescent lamp comprising:

an elongated glass tube, a layer of a light opaque pigmented material coating the interior surface of said glass tube, a layer of a reflective material superimposed over said opaque pigmented layer, a first logo defined by the ablation of a portion of said pigmented and reflective layer formed on the internal surface of said glass tube, a first layer of a fluorescent material superimposed onto said pigmented layer and reflective layer, said first layer of fluorescent material covering said ablated portion of said pigmented and reflective layers defining said first logo, a second logo defined by ablation of a portion of said superimposed pigmented layer, reflective layer and said first fluorescent layer, and a second layer of fluorescent material superimposed onto said first layer of fluorescent material, said second layer of fluorescent material underlying each of said first and second logos, each of said first and second layers of fluorescent material being capable of emitting light of a different color when said lamp is energized so that said first and second logos are illuminated with different color light.

* * * * *